US010965036B2

(12) United States Patent
Goto

(10) Patent No.: US 10,965,036 B2
(45) Date of Patent: Mar. 30, 2021

(54) ANTENNA SYSTEM, ANTENNA SUBSTRATE, AND ANTENNA ELEMENT

(71) Applicant: TDK CORPORATION, Tokyo (JP)

(72) Inventor: Tetsuzo Goto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 44 days.

(21) Appl. No.: 16/390,346

(22) Filed: Apr. 22, 2019

(65) Prior Publication Data

US 2019/0372230 A1 Dec. 5, 2019

(30) Foreign Application Priority Data

May 30, 2018 (JP) ..... JP2018-102969
May 30, 2018 (JP) ..... JP2018-102970

(51) Int. Cl.

| | |
|---|---|
| ***H01Q 9/40*** | (2006.01) |
| ***H01Q 5/50*** | (2015.01) |
| ***H01Q 13/10*** | (2006.01) |
| ***H01Q 9/04*** | (2006.01) |
| ***H01Q 1/38*** | (2006.01) |

(52) U.S. Cl.

CPC ..... *H01Q 9/40* (2013.01); *H01Q 1/38* (2013.01); *H01Q 5/50* (2015.01); *H01Q 9/0407* (2013.01); *H01Q 13/10* (2013.01)

(58) Field of Classification Search

None

See application file for complete search history.

(56) References Cited

U.S. PATENT DOCUMENTS 6,433,742 B1 * 8/2002 Crawford ..... H01Q 1/242 343/700 MS
8,786,499 B2 * 7/2014 Nissinen ..... G09F 19/22 343/702

FOREIGN PATENT DOCUMENTS

| | | | |
|---|---|---|---|
| CN | 101217217 | A | 7/2008 |
| CN | 106067605 | A | 11/2016 |
| CN | 207250709 | U | 4/2018 |
| JP | 2007-329974 | A | 12/2007 |

* cited by examiner

*Primary Examiner* — Crystal L Hammond
(74) *Attorney, Agent, or Firm* — Oliff PLC

(57) ABSTRACT

An antenna system includes an antenna substrate, and an antenna element mounted on the antenna substrate. The antenna substrate includes a substrate body, a first ground layer, a feed line, and a first radiation element. The feed line includes a first connection. The first radiation element includes a width-changing portion and a second connection. The antenna element includes an element body, a first terminal, a second terminal, and a second radiation element. The second radiation element is provided in the element body and connects the first terminal and the second terminal. The first terminal is connected to the first connection. The second terminal is connected to the second connection.

16 Claims, 11 Drawing Sheets

ANTENNA SYSTEM, ANTENNA SUBSTRATE, AND ANTENNA ELEMENT

BACKGROUND OF THE INVENTION

1. Field of the Invention

The present invention relates to a wideband capable antenna system, and to an antenna substrate and an antenna element used to construct the antenna system.

2. Description of the Related Art

Examples of known wireless communication technologies include Ultra Wide Band (UWB). UWB provides wireless communications over a wide bandwidth of 500 MHz or more, for example.

Among known antennas suitable for UWB or wideband capable antennas is a monopole antenna including a plate-shaped radiation element, the radiation element including a portion that increases in width with increasing distance from a feed point and a ground plane. The portion that increases in width with increasing distance from the feed point and the ground plane serves to keep the input impedance of the radiation element substantially constant over a wide band.

As a monopole antenna as described above, JP 2007-329974A discloses an antenna system constituted of a dielectric substrate and an antenna section, the antenna section being formed of a thin conductor and lying on the dielectric substrate.

Antennas for use particularly with communication apparatuses of miniature size must undergo miniaturization. However, it is difficult to miniaturize the monopole antenna having, as described above, a plate-shaped radiation element including a portion that increases in width with increasing distance from the feed point and the ground plane, because such a radiation element has a relatively large footprint.

SUMMARY OF THE INVENTION

It is an object of the present invention to provide a wideband capable and miniaturizable antenna system, and an antenna substrate and an antenna element enabling the provision of such an antenna system.

An antenna system of the present invention includes an antenna substrate and an antenna element. The antenna substrate includes a substrate body, a first ground layer, a feed line, and a first radiation element of a flat plate shape. The substrate body is formed of a first dielectric, and has a first surface and a second surface opposite to each other. The first ground layer and the first radiation element are each formed of a conductor and disposed on the first surface. The feed line includes a first connection disposed on the first surface. The first radiation element is separated from the first ground layer and the feed line, and spaced from the first ground layer and the first connection in a first direction parallel to the first surface. The first radiation element includes a first width-changing portion and a second connection. The first width-changing portion is a portion whose width in a second direction increases with increasing distance from the first connection in the first direction, the second direction being parallel to the first surface and perpendicular to the first direction.

The antenna element includes an element body, a first terminal, a second terminal, and a second radiation element. The element body is formed of a second dielectric and has an outer surface. The second dielectric has a relative permittivity higher than that of the first dielectric. The first and second terminals are disposed on the outer surface of the element body. The second radiation element is formed of a conductor, provided in the element body, and electrically connects the first terminal and the second terminal. The antenna element is mounted on the antenna substrate with the first terminal connected to the first connection and the second terminal connected to the second connection.

In the antenna system of the present invention, the first radiation element may have a first end closest to the first connection, and a second end that is opposite to the first end in the first direction. The distance between the first end and the second connection may be smaller than or equal to 1/10 of the distance between the first end and the second end.

In the antenna system of the present invention, the second radiation element may include a second width-changing portion whose width in the second direction increases with increasing distance from the first terminal in the first direction.

A maximum value of the width in the second direction of the second width-changing portion may be smaller than a minimum value of the width in the second direction of the first width-changing portion.

The second radiation element may further include a line portion provided in series with respect to the second width-changing portion. The line portion may be shaped to extend about an axis that is in a third direction perpendicular to the first and second directions. The second width-changing portion and the line portion may be at locations different from each other in the third direction.

In the antenna system of the present invention, the first ground layer may include two portions spaced from each other. In such a case, the feed line may extend to pass between the two portions of the first ground layer.

In the antenna system of the present invention, the antenna substrate may further include a second ground layer formed of a conductor and disposed on the second surface, and a plurality of through holes extending through the substrate body and electrically connecting the first ground layer and the second ground layer.

An antenna substrate of the present invention is one on which an antenna element is to be mounted. The antenna element includes a first terminal, a second terminal, and a second radiation element for electrically connecting the first terminal and the second terminal.

The antenna substrate of the present invention includes a substrate body, a first ground layer, a feed line, and a first radiation element of a flat plate shape. The substrate body is formed of a dielectric, and has a first surface and a second surface opposite to each other. The first ground layer and the first radiation element are each formed of a conductor and disposed on the first surface. The feed line includes a first connection disposed on the first surface. The first radiation element is separated from the first ground layer and the feed line, and spaced from the first ground layer and the first connection in a first direction parallel to the first surface. The first radiation element includes a width-changing portion and a second connection. The width-changing portion is a portion whose width in a second direction increases with increasing distance from the first connection in the first direction, the second direction being parallel to the first surface and perpendicular to the first direction. The first connection and the second connection are portions to which the first terminal and the second terminal of the antenna element are to be connected, respectively.

In the antenna substrate of the present invention, the first radiation element may have a first end closest to the first connection, and a second end that is opposite to the first end in the first direction. The distance between the first end and the second connection may be smaller than or equal to 1/10 of the distance between the first end and the second end.

In the antenna substrate of the present invention, the first ground layer may include two portions spaced from each other. In such a case, the feed line may extend to pass between the two portions of the first ground layer.

The antenna substrate of the present invention may further include a second ground layer formed of a conductor and disposed on the second surface, and a plurality of through holes extending through the substrate body and electrically connecting the first ground layer and the second ground layer.

An antenna element of the present invention is configured to be mounted on an antenna substrate, the antenna substrate including a feed line and a first radiation element separated from each other. The antenna element includes: an element body formed of a dielectric and having an outer surface; a first terminal and a second terminal disposed on the outer surface of the element body; and a second radiation element formed of a conductor and provided in the element body.

The second radiation element electrically connects the first terminal and the second terminal. The first terminal is configured to be connected to the feed line of the antenna substrate. The second terminal is configured to be connected to the first radiation element of the antenna substrate.

In the antenna element of the present invention, the outer surface of the element body may include a facing surface configured to face the antenna substrate. The second radiation element may include a width-changing portion whose width in a second direction increases with increasing distance from the first terminal in a first direction, the first direction being parallel to the facing surface, the second direction being parallel to the facing surface and perpendicular to the first direction. The second radiation element may further include a line portion provided in series with respect to the width-changing portion. The line portion may be shaped to extend about an axis that is in a third direction perpendicular to the first and second directions. The width-changing portion and the line portion may be at locations different from each other in the third direction.

In the antenna system of the present invention, the first connection of the feed line of the antenna substrate and the second connection of the first radiation element of the antenna substrate are connected via the second radiation element of the antenna element. The second radiation element is provided in the element body, which is formed of the second dielectric having a relative permittivity higher than that of the first dielectric forming the substrate body. By virtue of the foregoing, the present invention achieves a reduction in the footprint of the first and second radiation elements, thus providing a wideband capable and miniaturizable antenna system.

The antenna substrate and the antenna element of the present invention enable the provision of an antenna system having the above-described advantages.

Other and further objects, features and advantages of the invention will appear more fully from the following description.

DETAILED DESCRIPTION OF THE PREFERRED EMBODIMENT

Figure 1:
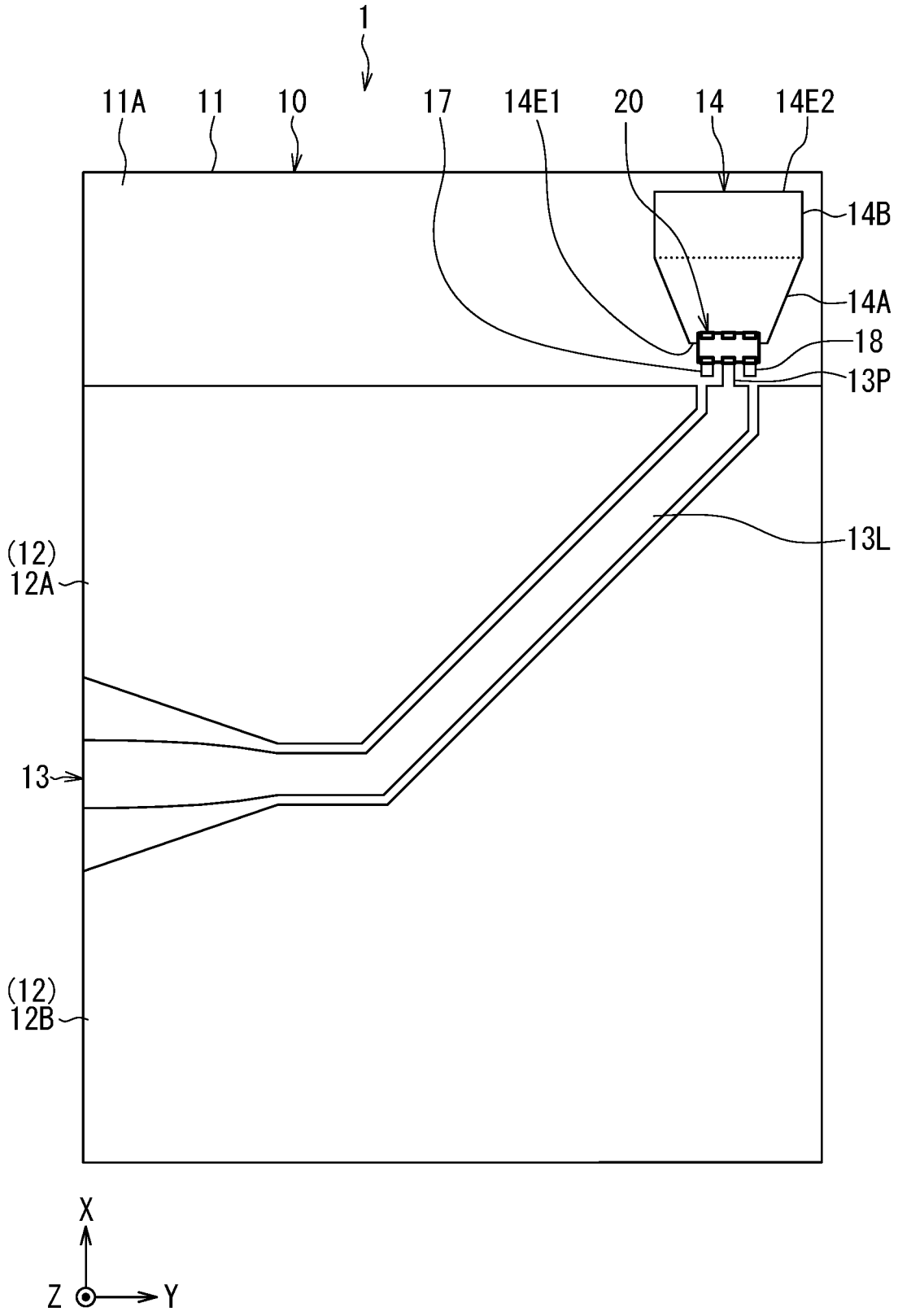
FIG. 1 is a plan view of an antenna system according to an embodiment of the invention.

A preferred embodiment of the present invention will now be described in detail with reference to the drawings. FIG. 1 is a plan view of an antenna system 1 according to the embodiment. As shown in FIG. 1, the antenna system 1 includes an antenna substrate 10 and an antenna element 20 according to the embodiment. The antenna element 20 is mounted on the antenna substrate 10.

Figure 2:
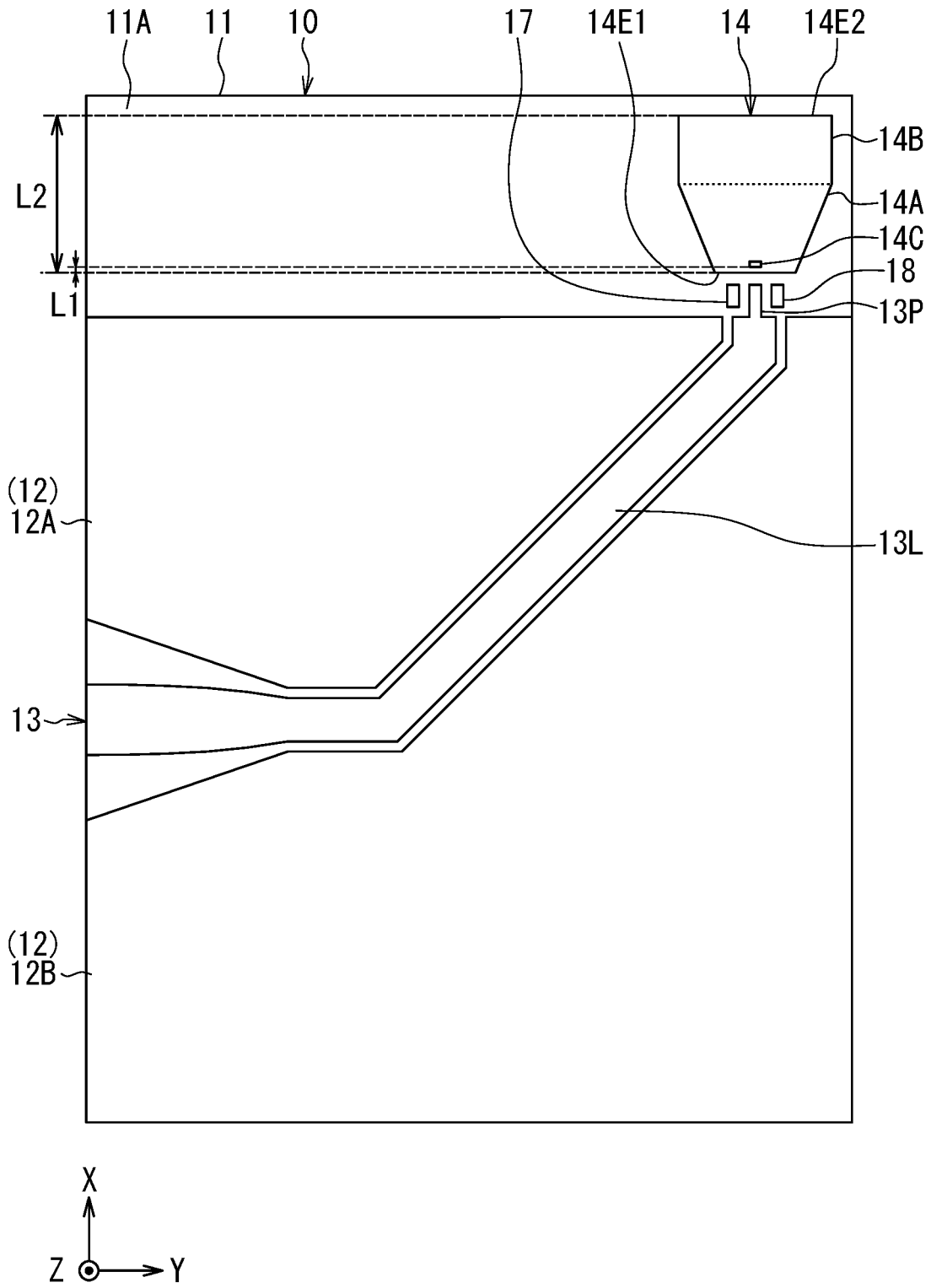
FIG. 2 is a plan view of an antenna substrate of the antenna system of FIG. 1.
Figure 3:
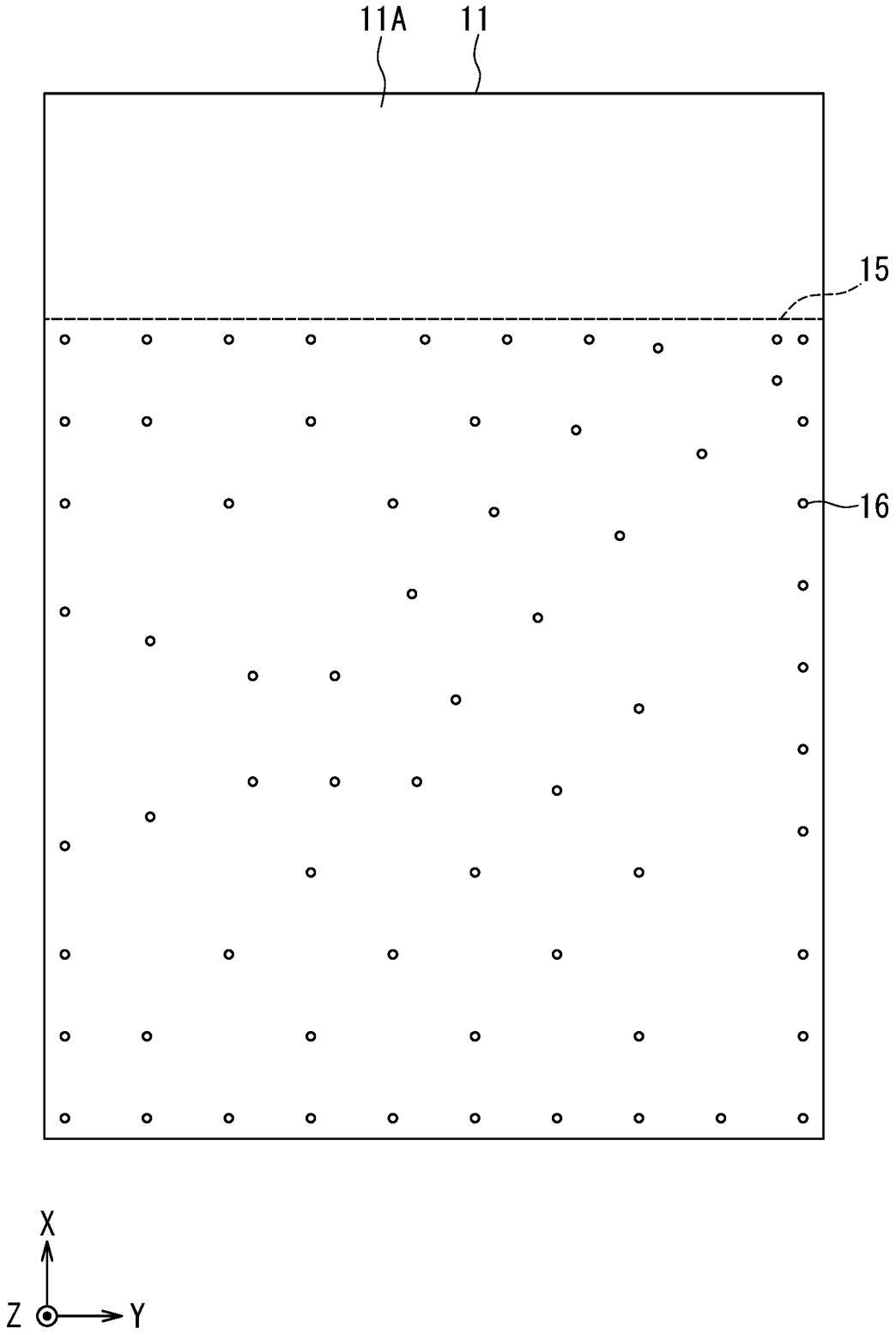
FIG. 3 is a plan view illustrating a portion of the antenna substrate of FIG. 2.
Figure 4:
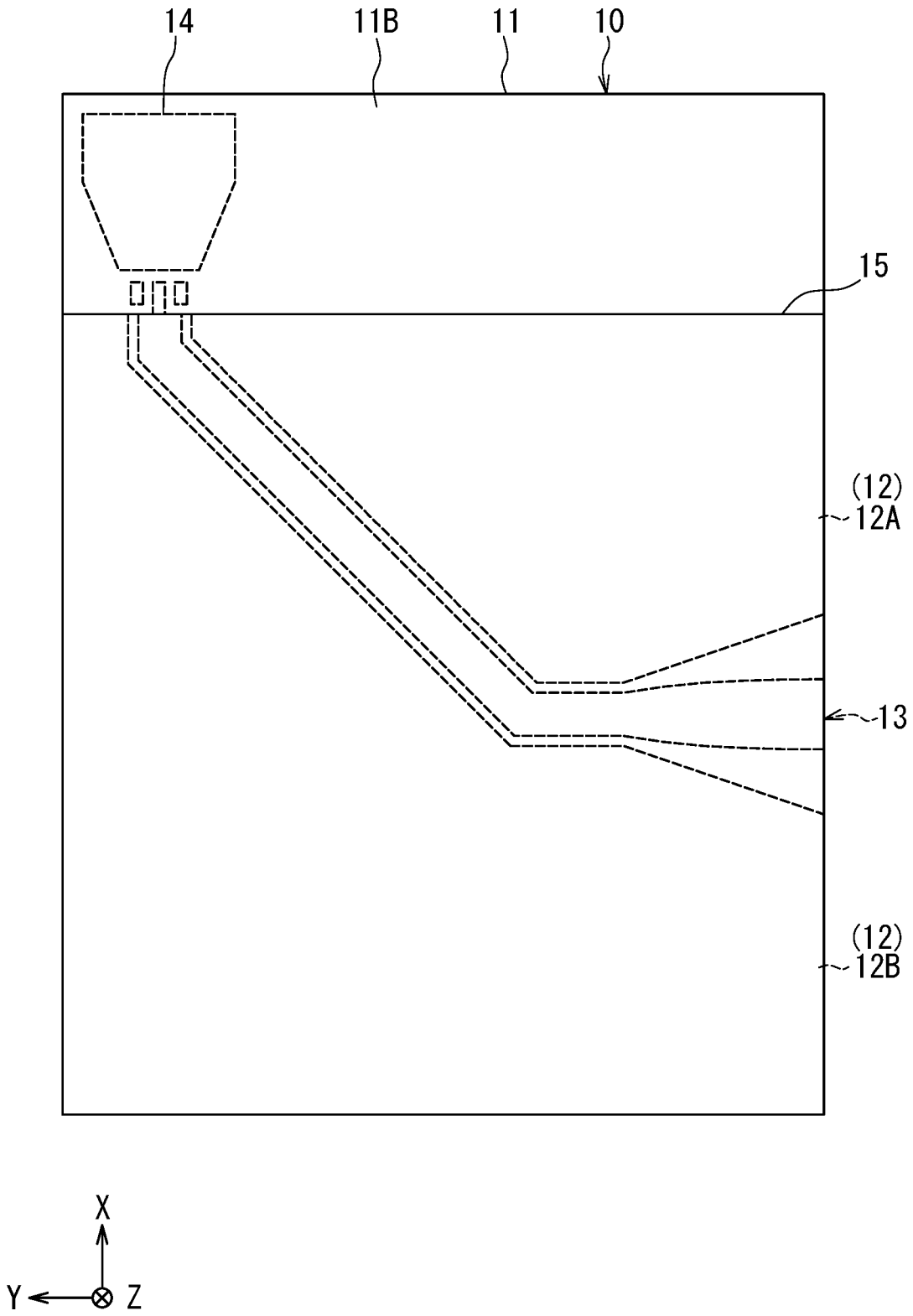
FIG. 4 is a bottom view of the antenna substrate of FIG. 2.
Figure 5:
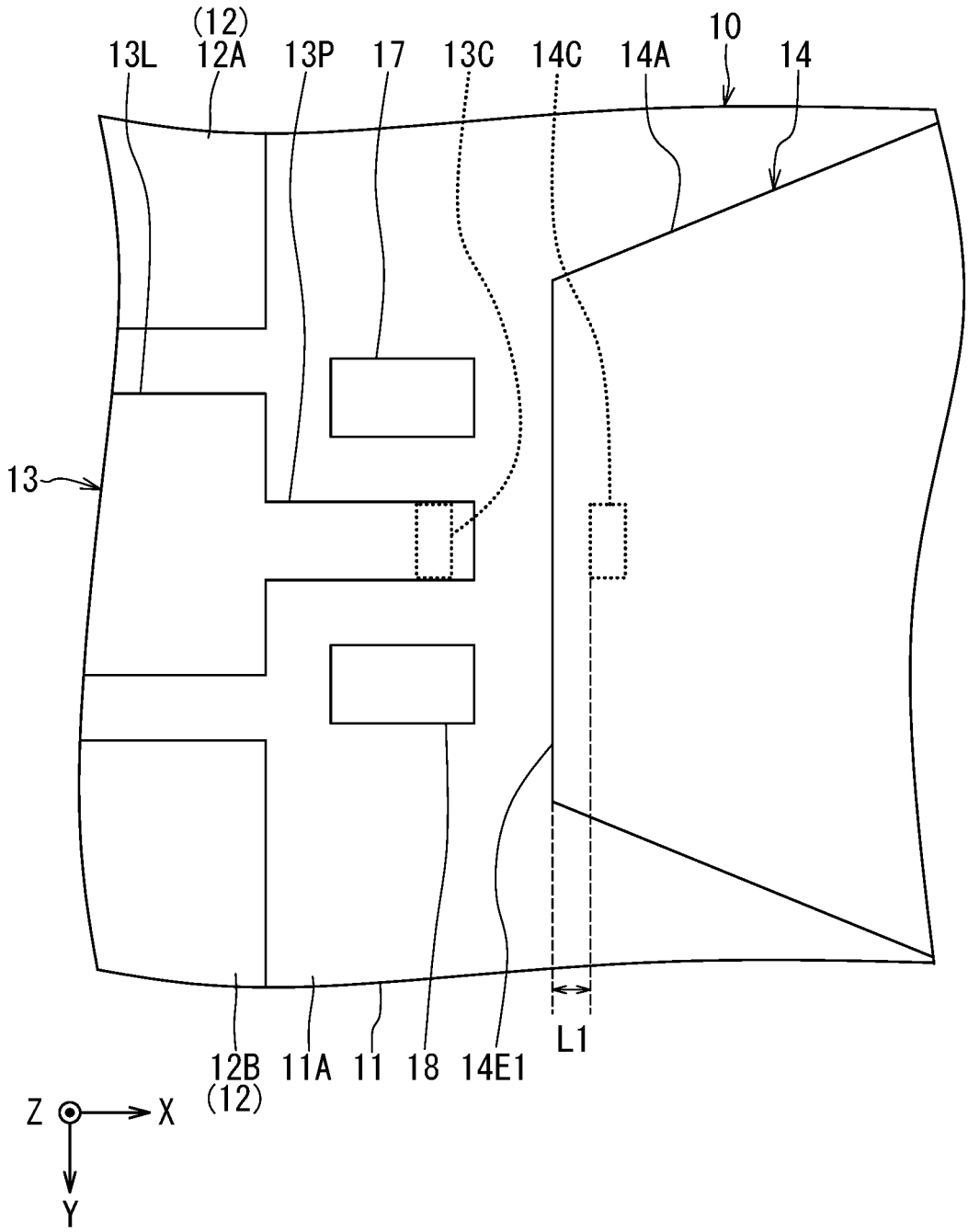
FIG. 5 is an enlarged plan view of a portion of the antenna substrate of FIG. 2.

The antenna substrate 10 will be described in detail with reference to FIG. 2 to FIG. 5. FIG. 2 is a plan view of the antenna substrate 10. FIG. 3 is a plan view illustrating a portion of the antenna substrate 10. FIG. 4 is a bottom view of the antenna substrate 10. FIG. 5 is an enlarged plan view of a portion of the antenna substrate 10.

As shown in FIG. 2, the antenna substrate 10 includes a substrate body 11, a first ground layer 12, a feed line 13, and a first radiation element 14 of a flat plate shape. FIG. 3 illustrates the substrate body 11. The substrate body 11 is formed of a first dielectric. Examples of the first dielectric include resin, glass, ceramic, and a composite material. The composite material may contain one or more of resin, glass, and ceramic. The first dielectric has a relative permittivity higher than that of air. The substrate body 11 has a first surface 11A and a second surface 11B (see FIG. 4) opposite to each other.

Now, we define X, Y, and Z directions as illustrated in FIG. 1 to FIG. 4. The X, Y, and Z directions are orthogonal to one another. The Z direction is perpendicular to the first surface 11A of the element body 11, and toward the first surface 11A from the second surface 11B. The X and Y directions are both parallel to the first surface 11A. The X direction corresponds to the first direction in the present invention. The Y direction corresponds to the second direction in the present invention. The Z direction corresponds to the third direction in the present invention. As used herein, the term "above" refers to positions located forward of a reference position in the Z direction, and "below" refers to positions opposite to "above" with respect to the the reference position.

The first ground layer 12 and the first radiation element 14 are each formed of a conductor and disposed on the first surface 11A, as shown in FIG. 2.

As shown in FIG. 5, the feed line 13 includes a first connection 13C disposed on the first surface 11A. The function of the first connection 13C will be described in detail later.

In this embodiment, as shown in FIG. 2, the first ground layer 12 includes two portions 12A and 12B spaced from each other. The feed line 13 is disposed on the first surface 11A and extends to pass between the two portions 12A and 12B of the first ground layer 12. The feed line 13 includes a line portion 13L interposed between the two portions 12A and 12B, and a protrusion 13P. The line portion 13L has an end closest to the first radiation element 14. The protrusion 13P protrudes toward the first radiation element 14 from the aforementioned end of the line portion 13L. In this embodiment, as shown in FIG. 5, the protrusion 13P of the feed line 13 includes the first connection 13C.

The first radiation element 14 is separated from the first ground layer 12 and the feed line 13, and spaced from the first ground layer 12 and the first connection 13C in the X direction, i.e., the first direction parallel to the first surface 11A.

The first radiation element 14 has a first end 14E1 closest to the first connection 13C, and a second end 14E2, the second end 14E2 being opposite to the first end 14E1 in the X direction.

The first radiation element 14 includes a first width-changing portion 14A, a constant-width portion 14B, and a second connection 14C. The first width-changing portion 14A and the constant-width portion 14B are arranged in this order in the X direction. In FIG. 1 and FIG. 2 the boundary between the first width-changing portion 14A and the constant-width portion 14B is shown by a dotted line.

The first width-changing portion 14A is a portion whose width in the Y direction, i.e., the second direction parallel to the first surface 11A and perpendicular to the first direction, increases with increasing distance from the first connection 13C in the X direction (the first direction). In this embodiment, the first width-changing portion 14A has a trapezoidal shape, in particular. The first width-changing portion 14A may have other shapes than trapezoidal, such as semicircular.

The constant-width portion 14B is a portion whose width in the Y direction is constant regardless of the position in the X direction. The width in the Y direction of the constant-width portion 14B is equal to the maximum value of the width in the Y direction of the first width-changing portion 14A.

In this embodiment, specifically, the second connection 14C is located in the first width-changing portion 14A. The function of the second connection 14C will be described in detail later. The second connection 14C is located near the first end 14E1. As shown in FIG. 2, the distance between the first end 14E1 and the second connection 14C will be denoted by the symbol L1, and the distance between the first end 14E1 and the second end 14E2 will be denoted by the symbol L2. The distance L1 may be smaller than or equal to 1/10 of the distance L2. The second connection 14C may be in contact with the first end 14E1. In such a case, the distance L1 is zero.

As shown in FIGS. 1, 2 and 5, the antenna substrate 10 further includes supports 17 and 18 disposed on the first surface 11A of the substrate body 11. The supports 17 and 18 are formed of a conductor. The supports 17 and 18 are located on opposite sides of the the protrusion 13P in the Y direction and spaced from the protrusion 13P.

As shown in FIG. 3 and FIG. 4, the antenna substrate 10 further includes a second ground layer 15 formed of a conductor and disposed on the second surface 11B of the substrate body 11, and a plurality of through holes 16 extending through the substrate body 11 and electrically connecting the first ground layer 12 and the second ground layer 15. In FIG. 3, each circle represents a through hole 16.

Figure 6:
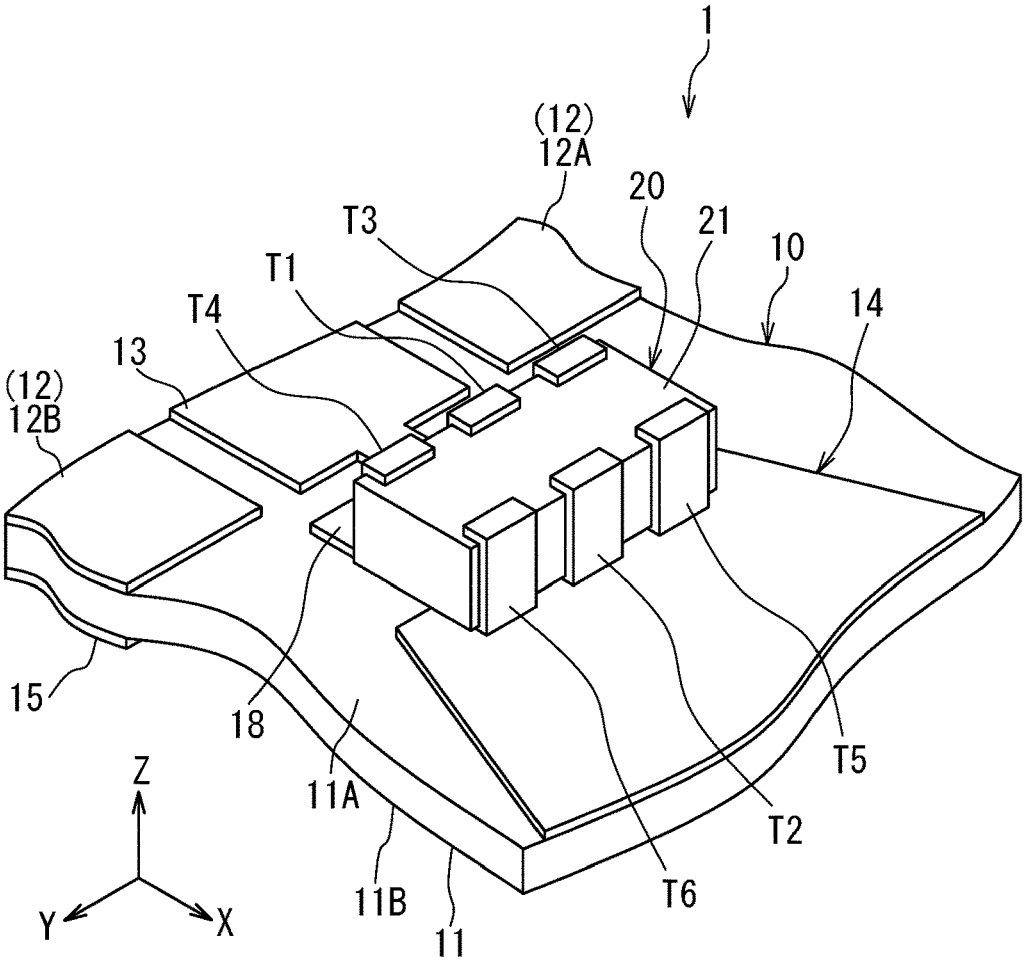
FIG. 6 is a perspective view illustrating an antenna element and its surroundings in the antenna system of FIG. 1.
Figure 7:
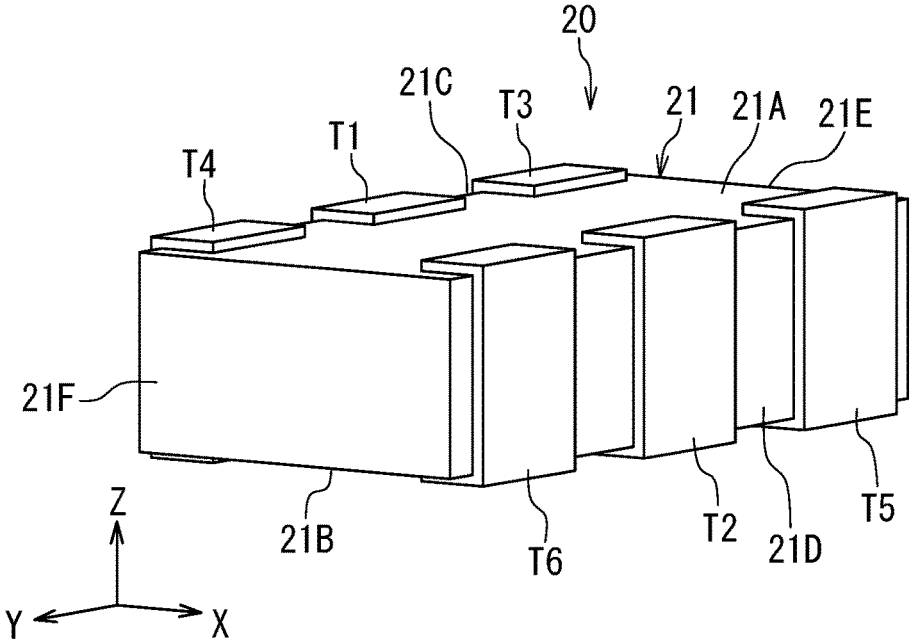
FIG. 7 is a perspective view of the antenna element of the antenna system of FIG. 1.
Figure 8:
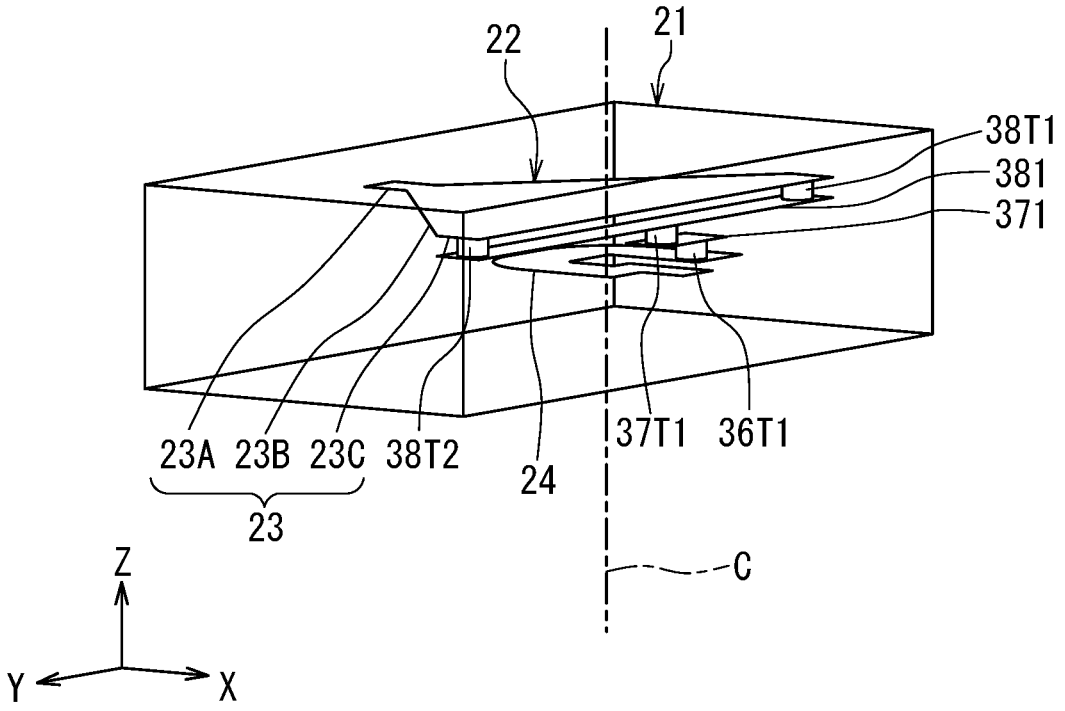
FIG. 8 is a perspective view illustrating the interior of the antenna element of FIG. 7.

Now, the antenna element 20 will be described in detail with reference to FIG. 6 to FIG. 10. FIG. 6 is a perspective view illustrating the antenna element 20 and its surroundings in the antenna system 1. FIG. 7 is a perspective view of the antenna element 20. FIG. 8 is a perspective view illustrating the interior of the antenna element 20.

The antenna element 20 includes an element body 21. The element body 21 has an outer surface. The element body 21 is formed of a second dielectric having a relative permittivity higher than that of the first dielectric forming the substrate body 11. Examples of the second dielectric include ceramic. The relative permittivity of the second dielectric is preferably 1.2 times that of the first dielectric or higher, and more preferably, 1.5 times that of the first dielectric or higher. The relative permittivity of the second dielectric is preferably 5 or higher.

For example, the element body 21 has a rectangular parallelepiped shape, as shown in FIGS. 6 and 7. In this case, the outer surface of the element body 21 includes a top surface 21A, a bottom surface 21B, and four side surfaces 21C, 21D, 21E, and 21F. The top surface 21A and the bottom surface 21B are located at opposite ends of the element body 21 in the Z direction. The bottom surface 21B is a facing surface configured to face the antenna substrate 10. The first direction, i.e., the X direction described previously is parallel to the bottom surface 21B. The top surface 21A is located above the bottom surface 21B. The side surfaces 21C and 21D are located at opposite ends of the element body 21 in the X direction. The side surface 21D is located forward of the side surface 21C in the X direction. The side surfaces 21E and 21F are located at opposite ends of the element body 21 in the Y direction. The side surface 21F is located forward of the side surface 21E in the Y direction.

The antenna element 20 further includes a first terminal T1, a second terminal T2, and other four terminals T3, T4, T5, and T6, all of which are disposed on the outer surface of the element body 21. The terminals T1, T3, and T4 are arranged to extend from the top surface 21A to the bottom surface 21B via the side surface 21C. The terminals T3 and T4 are located on opposite sides of the terminal T1 in the Y direction and spaced from the terminal T1. The terminals T2, T5, and T6 are arranged to extend from the top surface 21A to the bottom surface 21B via the side surface 21D. The terminals T5 and T6 are located on opposite sides of the terminal T2 in the Y direction and spaced from the terminal T2.

As shown in FIG. 8, the antenna element 20 further includes a second radiation element 22. The second radiation element 22 is formed of a conductor, provided in the element body 21, and electrically connects the first terminal T1 and the second terminal T2.

The second radiation element 22 includes a main conductor layer 23, a line portion 24, connection conductor layers 371 and 381, and through holes 36T1, 37T1, 38T1 and 38T2.

Figure 9:
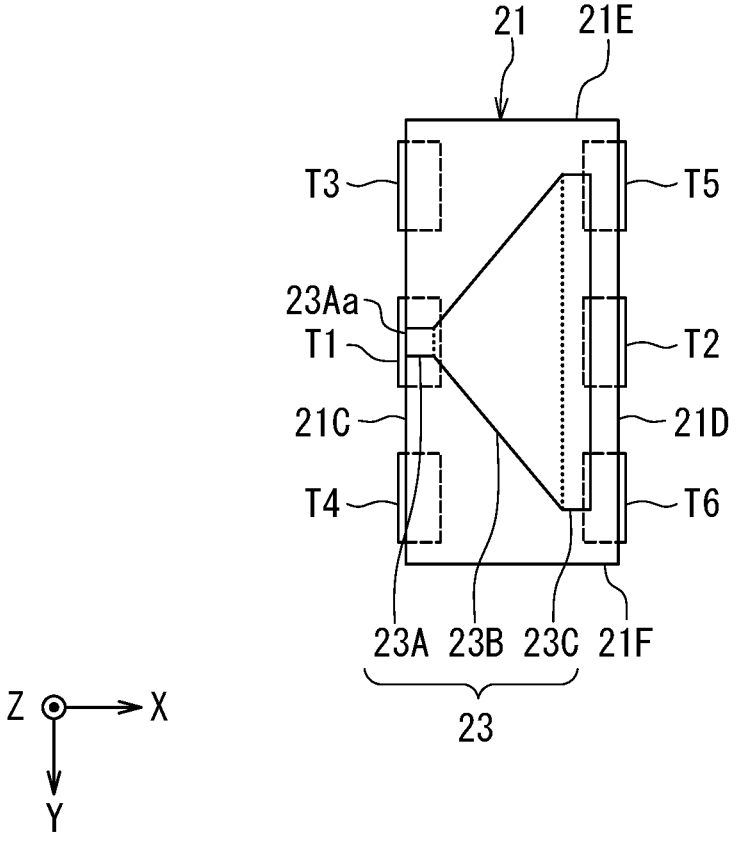
FIG. 9 is a plan view illustrating a main conductor layer and its surroundings in the antenna element of FIG. 7.

FIG. 9 is a plan view illustrating the main conductor layer 23 and its surroundings in the antenna element 20. As shown in FIG. 9, the main conductor layer 23 includes a constant-width portion 23A, a second width-changing portion 23B, and a constant-width portion 23C. The constant-width portion 23A, the second width-changing portion 23B, and the constant-width portion 23C are arranged in this order in the X direction. In FIG. 9, the boundary between the constant-width portion 23A and the second width-changing portion 23B, and the boundary between the second width-changing portion 23B and the constant-width portion 23C are shown by dotted lines.

The second width-changing portion 23B is a portion whose width in the second direction, i.e., the Y direction, increases with increasing distance from the first terminal T1 in the first direction, i.e., the X direction. In this embodiment, the second width-changing portion 23B has a trapezoidal shape, in particular. The second width-changing portion 23B may have other shapes than trapezoidal, such as semicircular. Since the main conductor layer 23 including the second width-changing portion 23B is a component of the second radiation element 22, one can say that the second radiation element 22 includes the second width-changing portion 23B.

The constant-width portions 23A and 23C are portions whose widths in the Y direction are constant regardless of the position in the X direction. The width in the Y direction of the constant-width portion 23A is equal to the minimum value of the width in the Y direction of the second width-changing portion 23B. The width in the Y direction of the constant-width portion 23C is equal to the maximum value of the width in the Y direction of the second width-changing portion 23B. The constant-width portion 23A has an end face 23Aa that is located in the side surface 21C and in contact with the first terminal T1.

Figure 10:
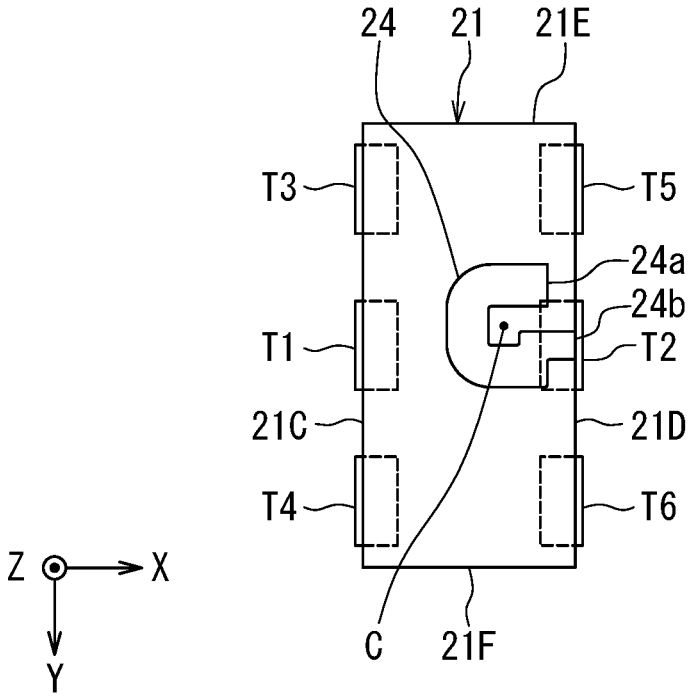
FIG. 10 is a plan view illustrating a line portion and its surroundings in the antenna element of FIG. 7.

FIG. 10 is a plan view illustrating the line portion 24 and its surroundings in the antenna element 20. The line portion 24 is formed of one conductor layer. As shown in FIG. 8 and FIG. 10, the line portion 24 is shaped to extend about an axis C. The axis C is in the Z direction, i.e., the third direction perpendicular to the first and second directions.

As shown in FIG. 8, the main conductor layer 23 and the line portion 24 are at locations different from each other in the third direction or the Z direction. In this embodiment, specifically, the line portion 24 is located below the main conductor layer 23.

As shown in FIG. 10, the line portion 24 has a first end 24*a* and a second end 24*b* opposite to each other. The second end 24*b* is located in the side surface 23D and in contact with the second terminal T2.

As shown in FIG. 8, the connection conductor layer 371 is interposed between the main conductor layer 23 and the line portion 24 in the Z direction. The connection conductor layer 381 is interposed between the main conductor layer 23 and the connection conductor layer 371 in the Z direction. The connection conductor layer 381 is shaped to be long in the Y direction and located below the constant-width portion 23C of the main conductor layer 23.

The through hole 36T1 connects a portion of the line portion 24 near the first end 24*a* to the connection conductor layer 371. The through hole 37T1 connects the connection conductor layer 371 to the connection conductor layer 381. The through holes 38T1 and 38T2 connect two portions of the connection conductor layer 381 near its opposite ends in the Y direction to two portions of the constant-width portion 23C near its opposite ends in the Y direction.

The first terminal T1 is electrically connected to the second terminal T2 via the constant-width portion 23A, the second width-changing portion 23B, the constant-width portion 23C, the through holes 38T1 and 38T2, the connection conductor layer 381, the through hole 37T1, the connection conductor layer 371, the through hole 36T1, and the line portion 24. The line portion 24 is provided in series with respect to the second width-changing portion 23B.

No conductor layer in the element body 21 is connected to the terminal T3, T4, T5, or T6.

Figure 11:
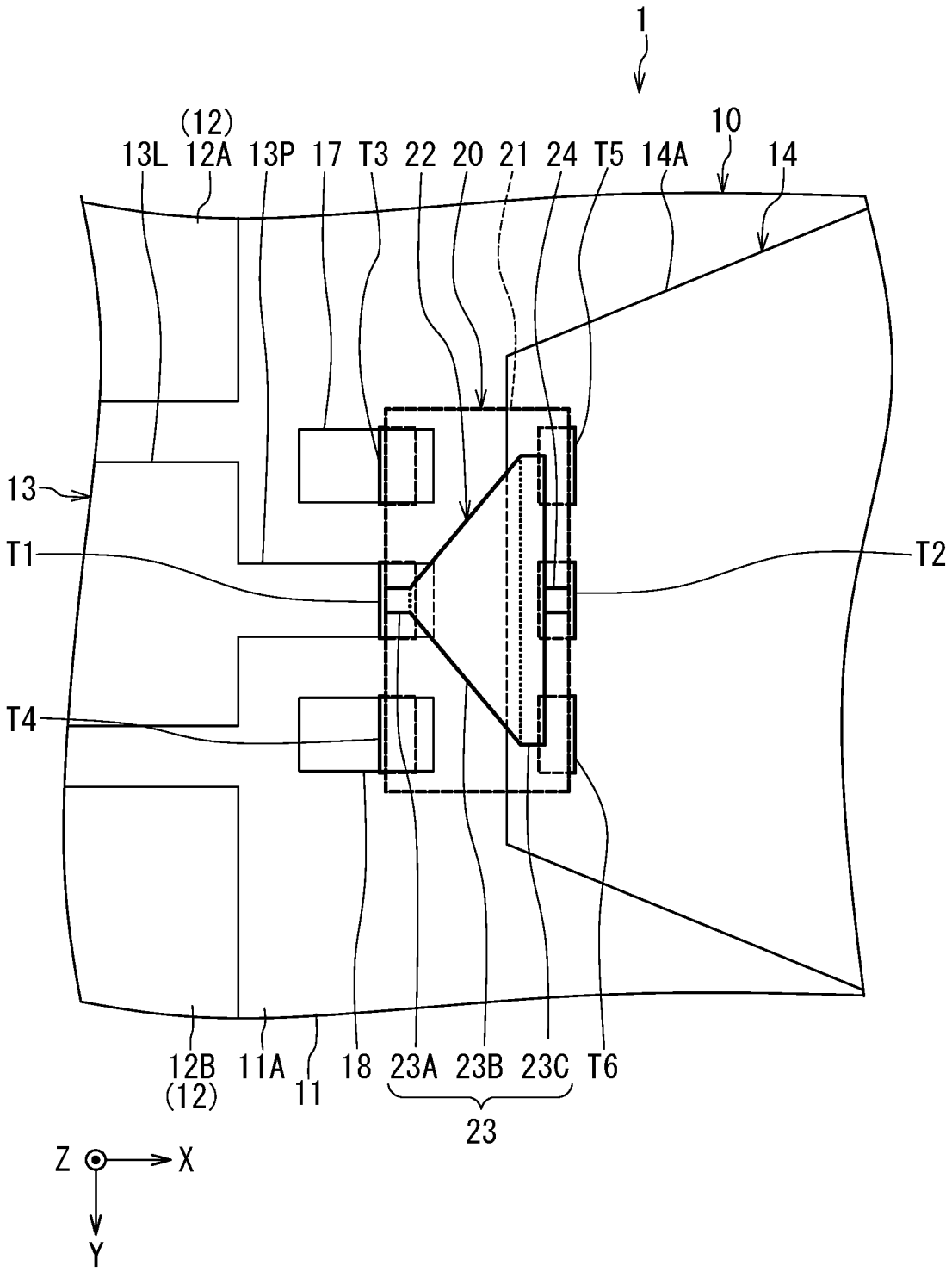
FIG. 11 is a plan view illustrating the antenna element and its surroundings in the antenna system of FIG. 1.

Reference is now made to FIGS. 5, 6 and 11 to describe the connection relationship between the antenna substrate 10 and the antenna element 20. FIG. 11 is a plan view illustrating the antenna element 20 and its surroundings in the antenna system 1.

The first connection 13C shown in FIG. 5 is a portion to which the first terminal T1 of the antenna element 20 is to be connected. The second connection 14C shown in FIG. 5 is a portion to which the second terminal T2 of the antenna element 20 is to be connected.

As shown in FIG. 6 and FIG. 11, the antenna element 20 is mounted on the antenna substrate 10 with the first terminal T1 connected to the first connection 13C (see FIG. 5) and the second terminal T2 connected to the second connection 14C (see FIG. 5). When the antenna element 20 is mounted on the antenna substrate 10, the terminal T3 is connected to the support 17, the terminal T4 is connected to the support 18, and the terminals T5 and T6 are connected to the first radiation element 14.

The maximum value of the width in the Y direction of the second width-changing portion 23B is smaller than the minimum value of the width in the Y direction of the first width-changing portion 14A, as shown in FIG. 11.

In this embodiment, the element body 21 is composed of a plurality of dielectric layers stacked together. Reference is now made to FIG. 12 to FIG. 17 to describe an example of the plurality of dielectric layers constituting the element body 21 and an example of the configurations of a plurality of conductor layers formed on the dielectric layers and a plurality of through holes formed in the dielectric layers.

In this example, the element body 21 includes ten dielectric layers stacked together. The ten dielectric layers will hereinafter be referred to as the first to tenth dielectric layers, respectively, in the order from bottom to top. The first to tenth dielectric layers will be denoted by the reference numerals 31 to 40, respectively.

Figure 12:
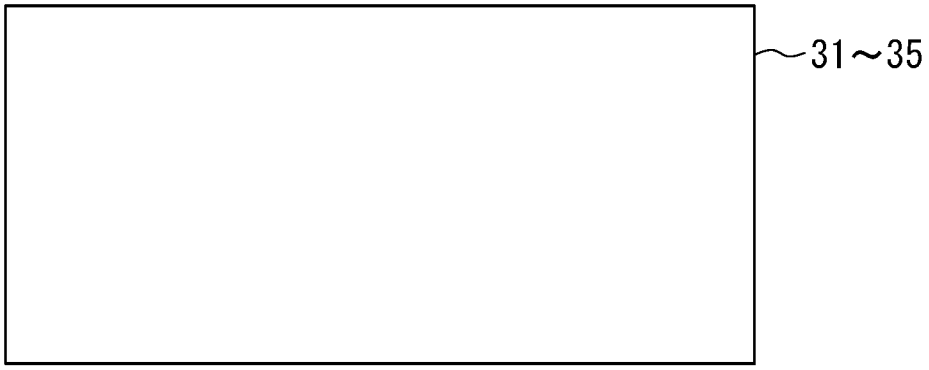
FIG. 12 is a plan view of first to fifth dielectric layers of an element body of the antenna element of FIG. 7.

FIG. 12 is a plan view of the first to fifth dielectric layers 31 to 35. None of the dielectric layers 31 to 35 has any conductor layer formed thereon or any through hole formed therein.

Figure 13:
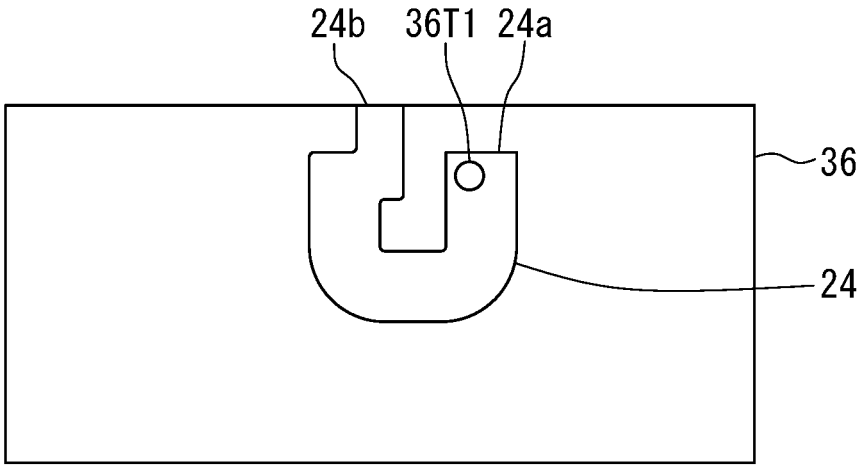
FIG. 13 is a plan view illustrating a patterned surface of a sixth dielectric layer of the element body of the antenna element of FIG. 7.

FIG. 13 illustrates a patterned surface of the sixth dielectric layer 36. The patterned surface of the dielectric layer 36 has the line portion 24 formed thereon. Further, the through hole 36T1 is formed in the dielectric layer 36. The through hole 36T1 is connected to a portion of the line portion 24 near the first end 24*a*.

Figure 14:
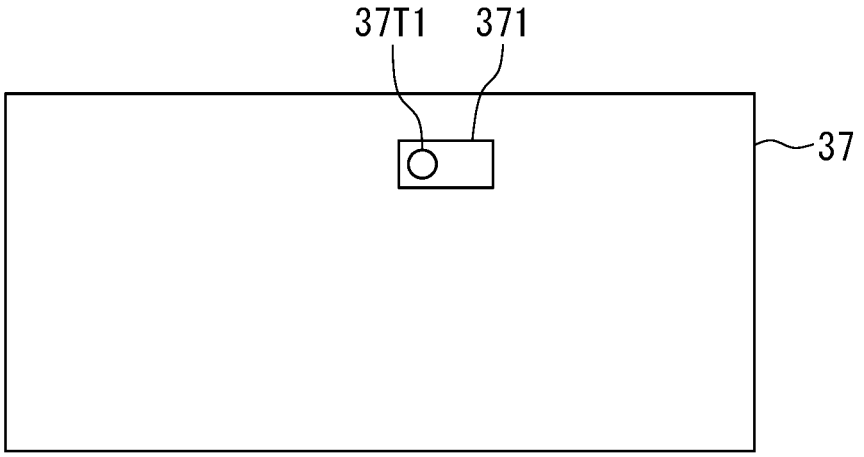
FIG. 14 is a plan view illustrating a patterned surface of a seventh dielectric layer of the element body of the antenna element of FIG. 7.

FIG. 14 illustrates a patterned surface of the seventh dielectric layer 37. The patterned surface of the dielectric layer 37 has the connection conductor layer 371 formed thereon. The through hole 36T1 shown in FIG. 13 is connected to the connection conductor layer 371. Further, the through hole 37T1 connected to the connection conductor layer 371 is formed in the dielectric layer 37.

Figure 15:
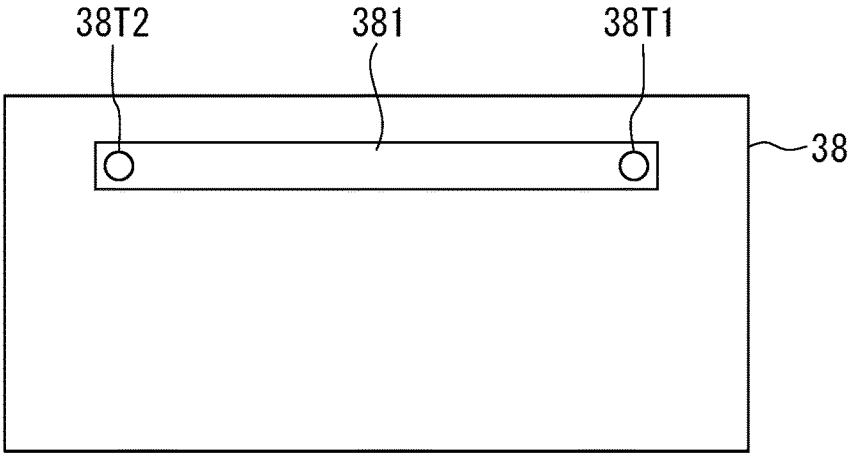
FIG. 15 is a plan view illustrating a patterned surface of an eighth dielectric layer of the element body of the antenna element of FIG. 7.

FIG. 15 illustrates a patterned surface of the eighth dielectric layer 38. The patterned surface of the dielectric layer 38 has the connection conductor layer 381 formed thereon. The through hole 37T1 shown in FIG. 14 is connected to the connection conductor layer 381. Further, the through holes 38T1 and 38T2 connected to the connection conductor layer 381 are formed in the dielectric layer 38.

Figure 16:
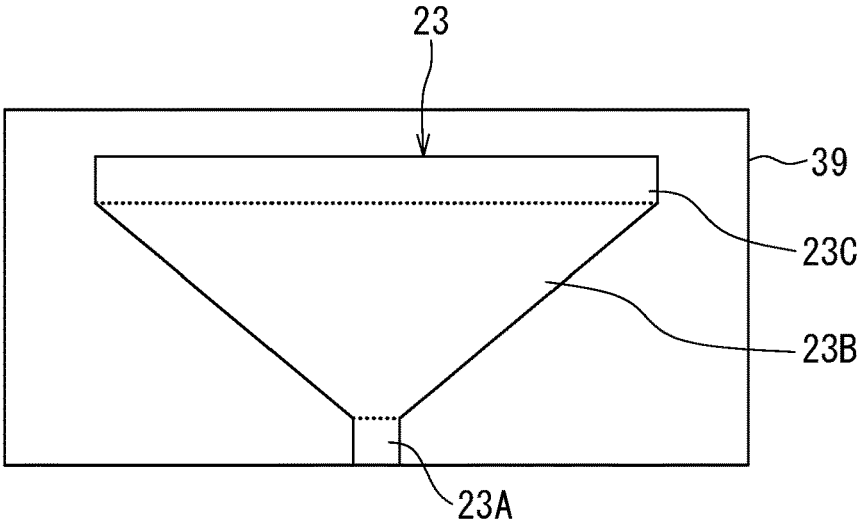
FIG. 16 is a plan view illustrating a patterned surface of a ninth dielectric layer of the element body of the antenna element of FIG. 7.

FIG. 16 illustrates a patterned surface of the ninth dielectric layer 39. The patterned surface of the dielectric layer 39 has the main conductor layer 23 formed thereon. The through holes 38T1 and 38T2 shown in FIG. 15 are connected to the constant-width portion 23C of the main conductor layer 23.

Figure 17:
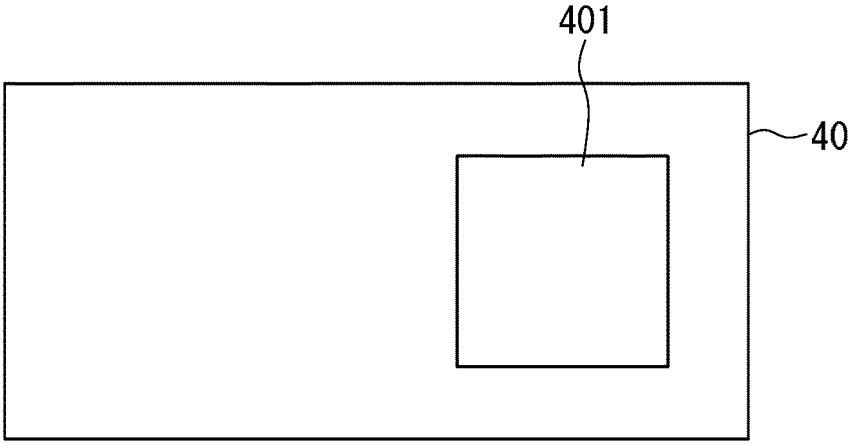
FIG. 17 is a plan view illustrating a patterned surface of a tenth dielectric layer of the element body of the antenna element of FIG. 7.

FIG. 17 illustrates a patterned surface of the tenth dielectric layer 40. The patterned surface of the dielectric layer 40 has a conductor layer 401 formed thereon. The conductor layer 401 is used as a mark. FIG. 8 omits the illustration of the conductor layer 401.

The element body 21 is formed by stacking the first to tenth dielectric layers 31 to 40 with the patterned surfaces of the sixth to tenth dielectric layers 36 to 40 facing downward. A surface of the tenth dielectric layer 40 opposite to the patterned surface constitutes the top surface 21A.

The function of the antenna system 1 according to the embodiment will now be described. The antenna system 1 is constituted of the antenna substrate 10 and the antenna element 20. The antenna element 20 is mounted on the antenna substrate 10 with the first terminal T1 connected to the first connection 13C and the second terminal T2 connected to the second connection 14C.

The first connection 13C, to which the first terminal T1 is to be connected, is provided in the feed line 13. The second connection 14C, to which the second terminal T2 is to be connected, is provided in the first radiation element 14. The first radiation element 14 is separated from the first ground layer 12 and the feed line 13, and spaced from the first ground layer 12 and the first connection 13C in the X direction.

The second radiation element 22 of the antenna element 20 electrically connects the first terminal T1 and the second terminal T2. Thus, when the antennal element 20 is mounted on the antenna substrate 10 with the first terminal T1 connected to the first connection 13C and the second terminal T2 connected to the second connection 14C, the feed line 13 of the antenna substrate 10 and the first radiation element 14 of the antenna substrate 10 are connected via the second radiation element 22 of the antenna element 20.

The antenna system 1 functions as a monopole antenna. The connected first and second radiation elements 14 and 22 correspond to a radiation element of the monopole antenna. The first connection 13C corresponds to a feed point. The first ground layer 12 constitutes a ground plane.

The first radiation element 14 includes the first width-changing portion 14A. The second radiation element 22 includes the second width-changing portion 23B. The first width-changing portion 14A is a portion whose width in the Y direction increases with increasing distance from the first connection 13C in the X direction. The second width-changing portion 23B is a portion whose width in the Y direction increases with increasing distance from the first terminal T1 in the X direction. The first and second width-changing portions 14A and 23B are thus portions that increase in width with increasing distance from the feed point and the ground plane. The first and second width-changing portions 14A and 23B perform the function to keep the input impedances of the first and second radiation elements 14 and 22, which correspond to a radiation element of a monopole antenna, substantially constant over a wide band. By virtue of this, the antenna system 1 functions as a wideband capable monopole antenna, in particular. The antenna system 1 is thus suited for UWB.

The advantage of the antenna system 1 according to the embodiment will now be described with comparison to an antenna system of each of a first and a second comparative example.

The antenna system of the first comparative example has a feed line including a feed point, a ground plane, and a radiation element disposed on a substrate formed of the first dielectric. The radiation element of the first comparative example is formed of one conductor layer, and directly connected to the feed point. The radiation element of the first comparative example includes a portion whose width in the Y direction increases with increasing distance from the feed point and the ground plane in the X direction. The radiation element of the first comparative example is provided as a substitute for the first and second radiation elements 14 and 22 of the embodiment.

The antenna system of the first comparative example has the disadvantage of being difficult to miniaturize because the radiation element has a relatively large footprint.

In the antenna system 1 according to the embodiment, as mentioned above, the connected first and second radiation elements 14 and 22 correspond to a radiation element of a monopole antenna. In the embodiment, the second radiation element 22 is provided in the element body 21 formed of the second dielectric, and can thus be smaller in size compared to a radiation element that functions equivalently to the second radiation element 22 but is provided outside a dielectric body. This contributes to the miniaturization of the antenna system 1.

Now, detailed comparisons will be made between the radiation element of the first comparative example and the first and second radiation elements 14 and 22 of the embodiment. Here, for the sake of convenience, the radiation element of the first comparative example will be divided into a first portion and a second portion. The first portion corresponds to the first radiation element 14 of the embodiment, and the second portion corresponds to the second radiation element 22 of the embodiment. The first portion is the same or substantially the same as the first radiation element 14 in shape and size.

Next, the second portion and the second radiation element 22 will be compared. The second radiation element 22 is provided in the element body 21 formed of the second dielectric, which is higher in relative permittivity than the first dielectric. Given the same frequency, a wavelength corresponding to the frequency is shorter in the second dielectric than in the air and than in the first dielectric. Therefore, when physical lengths corresponding to the same electrical length are compared between the second portion and the second radiation element 22, the physical length of the second radiation element 22 is shorter than the physical length of the second portion. Furthermore, the second width-changing portion 23B of the second radiation element 22 is smaller than a portion of the second portion corresponding to the second width-changing portion 23B.

For the above-described reason, a physical length corresponding to the total electrical length of the first and second radiation elements 14 and 22 is shorter than a physical length corresponding to the electrical length of the radiation element of the first comparative example, and the footprint of the first and second radiation elements 14 and 22 is smaller than the footprint of the radiation element of the first comparative example. The antenna system 1 of the embodiment is thus more miniaturizable than the antenna system of the first comparative example.

In the embodiment, the second radiation element 22 includes the line portion 24 provided in series with respect to the second width-changing portion 23B. The total of the electrical length of the second radiation element 22 including the line portion 24 and the electrical length of the first radiation element 14 depends on the lowest usable frequency of the antenna system 1. The line portion 24 is shaped to extend about the Z-direction axis C. The second width-changing portion 23B and the line portion 24 are at locations different from each other in the Z direction. By virtue of these features, this embodiment provides a smaller distance between the first connection 13C (the feed point) and the second end 14E2 of the first radiation element 14, compared to a case where the second radiation element 22 does not include the line portion 24. This enables further miniaturization of the antenna system 1.

Next, the antenna system of the second comparative example will be described. The antenna system of the second comparative example has a feed line including a feed point, a ground plane, and a radiation element provided in a dielectric body formed of the second dielectric. The second dielectric is ceramic. The radiation element of the second comparative example is formed of one conductor layer, and directly connected to the feed line. The radiation element of the second comparative example includes a portion whose width in the Y direction increases with increasing distance from the feed point and the ground plane in the X direction. The radiation element of the second comparative example is provided as a substitute for the first and second radiation elements 14 and 22 of the embodiment.

The second comparative example enables downsizing of the radiation element compared to the first comparative example. However, the radiation element of the second comparative example is still relatively large. Accordingly, the dielectric body is also relatively large. In this case, the dielectric body formed of ceramic becomes susceptible to damage. The antenna system of the second comparative example thus has the disadvantage of being low in structural reliability.

In contrast, according to the embodiment of the invention, the first radiation element 14, which is relatively large, is disposed on the first surface 11A of the substrate body 11, and the second radiation element 22, which is relatively small, is disposed in the element body 21. Accordingly, in the embodiment, the element body 21 is small and resistant to damage. The antenna system 1 according to the embodiment is therefore high in structural reliability.

As has been described, the embodiment enables the provision of the antenna system 1 which is wideband capable, miniaturizable, and high in structural reliability.

In the antenna substrate 10 according to the embodiment, the first radiation element 14 is separated from the first ground layer 12 and the feed line 13. Further, the first connection 13C is provided in the feed line 13, and the second connection 14C is provided in the first radiation element 14. With the antenna substrate 10 of such a structure, the second radiation element 22 provided in the element body 21 of the antenna element 20 can be interposed between the feed line 13 and the first radiation element 14. This enables the provision of the antenna system 1 including the first radiation element 14 and the second radiation element 22 and achieving wideband capability and miniaturization. With an antenna substrate having a radiation element and a feed line directly connected to each other and disposed on a substrate body, it is impossible to provide a wideband capable and miniaturizable monopole antenna by allowing another radiation element in an antenna element to be interposed between the feed line and the radiation element of the antenna substrate.

Furthermore, in the antenna element 20 according to the embodiment, the second radiation element 22 provided in the element body 21 electrically connects the first terminal T1 and the second terminal T2 disposed on the outer surface of the element body 21. The antenna element 20 of such a structure makes it possible to connect the feed line 13 and the first radiation element 14 of the antenna substrate 10 via the second radiation element 22 provided in the element body 21. This enables the provision of the antenna system 1 including the first radiation element 14 and the second radiation element 22 and achieving wideband capability and miniaturization. With an antenna element in which a radiation element provided in an element body is connected only to a terminal to be connected to a feed point, it is impossible to provide a wideband capable and miniaturizable monopole antenna by connecting the radiation element provided in the antenna element to another radiation element provided as part of an antenna substrate.

The present invention is not limited to the foregoing embodiment, and various modifications may be made thereto. For example, the feed line may include a first connection disposed on the first surface 11A of the substrate body 11, a line portion disposed on the second surface 11B of the substrate body 11, and a through hole extending through the substrate body 11 and connecting the first connection and the line portion.

The first radiation element 14 may not include the constant-width portion 14B. The second radiation element 22 may include neither of, or only one of the constant-width portions 23A and 23C. The second radiation element 22 may not include the line portion 24.

Obviously, many modifications and variations of the present invention are possible in the light of the above teachings. Thus, it is to be understood that, within the scope of the appended claims and equivalents thereof, the invention may be practiced in other than the foregoing most preferable embodiment.

What is claimed is:

1. An antenna system comprising:

an antenna substrate that includes:

a substrate body that is formed of a first dielectric, and has a first surface and a second surface opposite to each other;

a first ground layer;

a feed line that includes a first connection disposed on the first surface; and a first radiation element of a flat plate shape, the first ground layer and the first radiation element being each formed of a conductor and disposed on the first surface, the first radiation element being separated from the first ground layer and the feed line, and spaced from the first ground layer and the first connection in a first direction parallel to the first surface, the first radiation element including a first width-changing portion and a second connection, the first width-changing portion being a portion whose width in a second direction increases with increasing distance from the first connection in the first direction, the second direction being parallel to the first surface and perpendicular to the first direction; and an antenna element including:

an element body formed of a second dielectric and having an outer surface, the second dielectric having a relative permittivity higher than that of the first dielectric;

a first terminal;

a second terminal, the first and second terminals being disposed on the outer surface of the element body; and a second radiation element formed of a conductor, provided in the element body, and electrically connecting the first terminal and the second terminal, wherein the antenna element is mounted on the antenna substrate with the first terminal connected to the first connection and the second terminal connected to the second connection.

2. The antenna system according to claim 1, wherein the first radiation element has a first end closest to the first connection, and a second end that is opposite to the first end in the first direction, and a distance between the first end and the second connection is smaller than or equal to 1/10 of a distance between the first end and the second end.

3. The antenna system according to claim 1, wherein the second radiation element includes a second width-changing portion whose width in the second direction increases with increasing distance from the first terminal in the first direction.

4. The antenna system according to claim 3, wherein a maximum value of the width in the second direction of the second width-changing portion is smaller than a minimum value of the width in the second direction of the first width-changing portion.

5. The antenna system according to claim 3, wherein the second radiation element further includes a line portion provided in series with respect to the second width-changing portion, and the line portion is shaped to extend about an axis that is in a third direction perpendicular to the first and second directions.

6. The antenna system according to claim 5, wherein the second width-changing portion and the line portion are at locations different from each other in the third direction.

7. The antenna system according to claim 1, wherein the first ground layer includes two portions spaced from each other, and the feed line extends to pass between the two portions of the first ground layer.

8. The antenna system according to claim 1, wherein the antenna substrate further includes a second ground layer formed of a conductor and disposed on the second surface, and a plurality of through holes extending through the substrate body and electrically connecting the first ground layer and the second ground layer.

9. An antenna substrate on which an antenna element is to be mounted, the antenna element including a first terminal, a second terminal, and a second radiation element for electrically connecting the first terminal and the second terminal, the antenna substrate comprising:

a substrate body formed of a dielectric, and having a first surface and a second surface opposite to each other;

a first ground layer;

a feed line including a first connection disposed on the first surface; and a first radiation element of a flat plate shape, the first ground layer and the first radiation element being each formed of a conductor and disposed on the first surface, the first radiation element being separated from the first ground layer and the feed line, and spaced from the first ground layer and the first connection in a first direction parallel to the first surface, the first radiation element including a width-changing portion and a second connection, the width-changing portion being a portion whose width in a second direction increases with increasing distance from the first connection in the first direction, the second direction being parallel to the first surface and perpendicular to the first direction, and the first connection and the second connection being portions to which the first terminal and the second terminal of the antenna element are to be connected, respectively.

10. The antenna substrate according to claim 9, wherein the first radiation element has a first end closest to the first connection, and a second end that is opposite to the first end in the first direction, and a distance between the first end and the second connection is smaller than or equal to 1/10 of a distance between the first end and the second end.

11. The antenna substrate according to claim 9, wherein the first ground layer includes two portions spaced from each other, and the feed line extends to pass between the two portions of the first ground layer.

12. The antenna substrate according to claim 9, further comprising a second ground layer formed of a conductor and disposed on the second surface, and a plurality of through holes extending through the substrate body and electrically connecting the first ground layer and the second ground layer.

13. An antenna element comprising:

an element body formed of a dielectric and having an outer surface;

a first terminal and a second terminal disposed on the outer surface of the element body; and a second radiation element formed of a conductor and provided in the element body, the second radiation element electrically connecting the first terminal and the second terminal, wherein the antenna element is configured to be mounted on an antenna substrate, the antenna substrate including a feed line and a first radiation element separated from each other, the first terminal is configured to be connected to the feed line of the antenna substrate, and the second terminal is configured to be connected to the first radiation element of the antenna substrate.

14. An antenna element configured to be mounted on an antenna substrate, the antenna substrate including a feed line and a first radiation element separated from each other, the antenna element comprising:

an element body formed of a dielectric and having an outer surface, the outer surface of the element body including a facing surface configured to face the antenna substrate;

a first terminal and a second terminal disposed on the outer surface of the element body, the first terminal being configured to be connected to the feed line of the antenna substrate, and the second terminal being configured to be connected to the first radiation element of the antenna substrate; and a second radiation element formed of a conductor and provided in the element body, the second radiation element electrically connecting the first terminal and the second terminal, the second radiation element including a width-changing portion whose width in a second direction increases with increasing distance from the first terminal in a first direction, the first direction being parallel to the facing surface, the second direction being parallel to the facing surface and perpendicular to the first direction.

15. The antenna element according to claim 14, wherein the second radiation element further includes a line portion provided in series with respect to the width-changing portion, and the line portion is shaped to extend about an axis that is in a third direction perpendicular to the first and second directions.

16. The antenna element according to claim 15, wherein the width-changing portion and the line portion are at locations different from each other in the third direction.

* * * * *